United States Patent [19]

Statham

[11] Patent Number: 4,547,093

[45] Date of Patent: Oct. 15, 1985

[54] PROTECTION OF VESSELS AND EQUIPMENT FROM MOVING ICE

[76] Inventor: John A. Statham, 68 Battenhall Ave., Worcester WR5 2HW, England

[21] Appl. No.: 517,873

[22] Filed: Jul. 27, 1983

[30] Foreign Application Priority Data

Aug. 10, 1982 [GB] United Kingdom ..... 8223050

[51] Int. Cl.[4] ..... E02B 15/02

[52] U.S. Cl. ..... 405/61; 405/195; 405/211; 405/217; 114/40

[58] Field of Search ..... 405/15, 16, 24–26, 405/61, 217; 114/40–42

[56] References Cited

U.S. PATENT DOCUMENTS

| | | | |
|---|---|---|---|
| 63,968 | 4/1867 | Voorhis | 405/61 |
| 307,393 | 10/1884 | Hyde | 405/26 |
| 1,314,743 | 9/1919 | Groat | 405/25 |
| 3,405,527 | 10/1968 | Farr et al. | 405/61 |
| 3,436,920 | 4/1969 | Blenkarn et al. | 405/61 |
| 3,761,133 | 9/1973 | Buckley | 114/42 X |
| 3,881,318 | 5/1975 | Galloway | 405/61 |
| 4,069,783 | 1/1978 | Morgan | 114/42 |
| 4,102,288 | 7/1978 | Berry et al. | 114/41 |
| 4,318,633 | 3/1982 | Tsang | 405/61 X |
| 4,326,822 | 4/1982 | Oshima et al. | 405/61 X |
| 4,422,399 | 12/1983 | Morgan | 114/42 |

FOREIGN PATENT DOCUMENTS

| | | | |
|---|---|---|---|
| 79171 | 6/1950 | Czechoslovakia | 405/15 |

*Primary Examiner*—Dennis L. Taylor

*Attorney, Agent, or Firm*—Flynn, Thiel, Boutell & Tanis

[57] ABSTRACT

An installation 18 is protected by a circular array of drag elements 2. Each drag element is anchored to the seabed and has teeth on its upper surface which penetrate, and decelerate, moving ice structures. Ice structures which move over the drag elements and enter the protection area have insufficient momentum to damage the installation.

15 Claims, 12 Drawing Figures

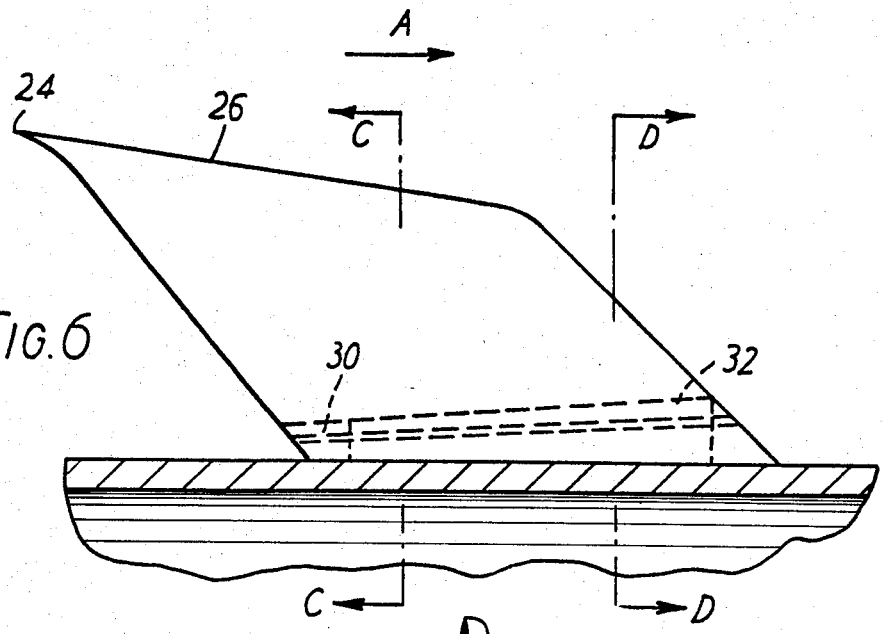
FIG. 6
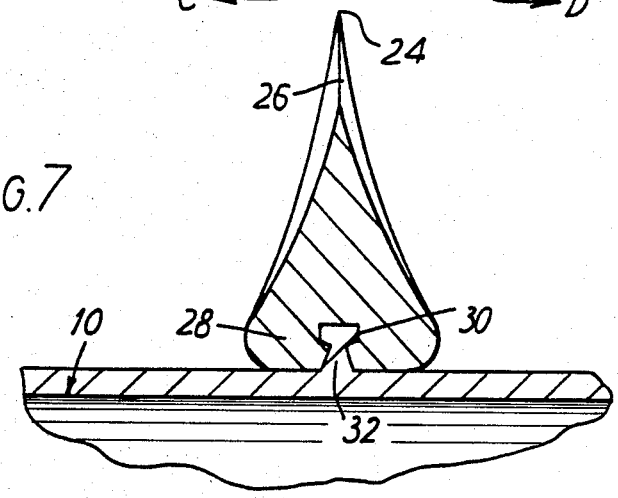
FIG. 7
FIG. 8
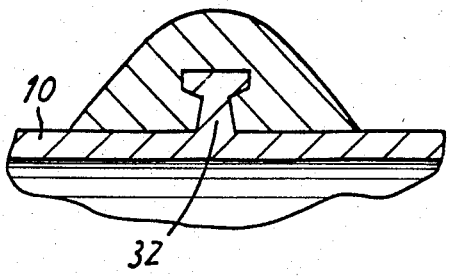

PROTECTION OF VESSELS AND EQUIPMENT FROM MOVING ICE

BACKGROUND OF THE INVENTION

The present invention relates to the protection of vessels and equipment, particularly static equipment such as drill ships, moored in polar regions. Such installations are vulnerable to damage from moving ice, especially pack ice, which comprises a fairly dense array of ice structures, up to about 100 million tonnes in mass, linked by sheet ice.

Various proposals have been made with a view to protecting installations from pack ice. The proposals have in common the idea of enabling installations to withstand the impact of ice moving at its normal speed. For example, one proposal is to support a production platform on a pillar which gradually widens beneath the surface of the water into a massive supporting base, restng on the water-bed. However, such a structure, known as a monocone, cannot resist a large ice structure and once off site cannot generally be returned until the pack ice thaws the following summer.

Another proposal is to build an artificial sand or gravel island on which to site the drilling equipment. Such an island would need to be massive to withstand the largest ice structures, would be difficult and expensive to construct, and would be subject to erosion.

A third proposal is to use a steel or concrete caisson filled with sand or gravel, sitting on a small artificial gravel island. However, such equipment could not feasibly be used in deep water.

According to a first aspect of the present invention there is provided apparatus for protecting an installation from floating ice moving towards the installation, comprising:

- an array of buoyant drag elements upstream of the installation;
- a number of underwater anchorages upstream of the installation;
- anchor lines connecting the drag elements to the anchorages;
- and means at the surface of the drag elements for engaging the under surface of ice moving over the drag elements, whereby the ice is decelerated.

The terms upstream and downstream in this specification refer to the directions of movement of the ice, as determined by the current and the wind.

The present invention seeks to overcome the problems arising from moving ice by steadily decelerating the ice as it passes over the drag elements, rather than by buttressing the installation.

In a preferred embodiment the means at the surface of the drag elements for engaging the under surface of the ice comprise teeth which, urged upwards by the drag elements, penetrate the ice. Such teeth are preferably three-sided in transverse cross section and have a point at their leading edge, to penetrate the ice. The teeth may be arranged in transversely staggered, longitudinally spaced, rows, such that no tooth follows the line of another tooth.

Preferably the drag elements form a generally circular array around the installation which is to be protected, so that the installation may be protected from ice moving in any direction. The number, size and distribution of elements is such that when ice has finished moving over drag elements its momentum is too low for it to cause any damage to the installation. The drag elements may thus enclose a protection area around the isntallation. As the ice is slowed down by the drag elements a wedge of relatively densely packed ice forms upstream of the protection area. The wedge tends to deflect further oncoming ice around the protection area.

According to a second aspect of the invention there is provided a structure having teeth projecting from its surface and being floatable in water, and connectable to an undercover anchorage.

Such a structure can act as a drag element as previously described.

BRIEF DESCRIPTION OF THE DRAWINGS

The invention will now be further described in greater detail, by way of example, with reference to the accompanying drawings, in which:

FIG. 6 is a more detailed side elevation of a tooth;

FIGS. 7 and 8 are transverse sections respectively through lines C—C and D—D of the tooth in FIG. 6;

DETAILED DESCRIPTION

Figure 1:
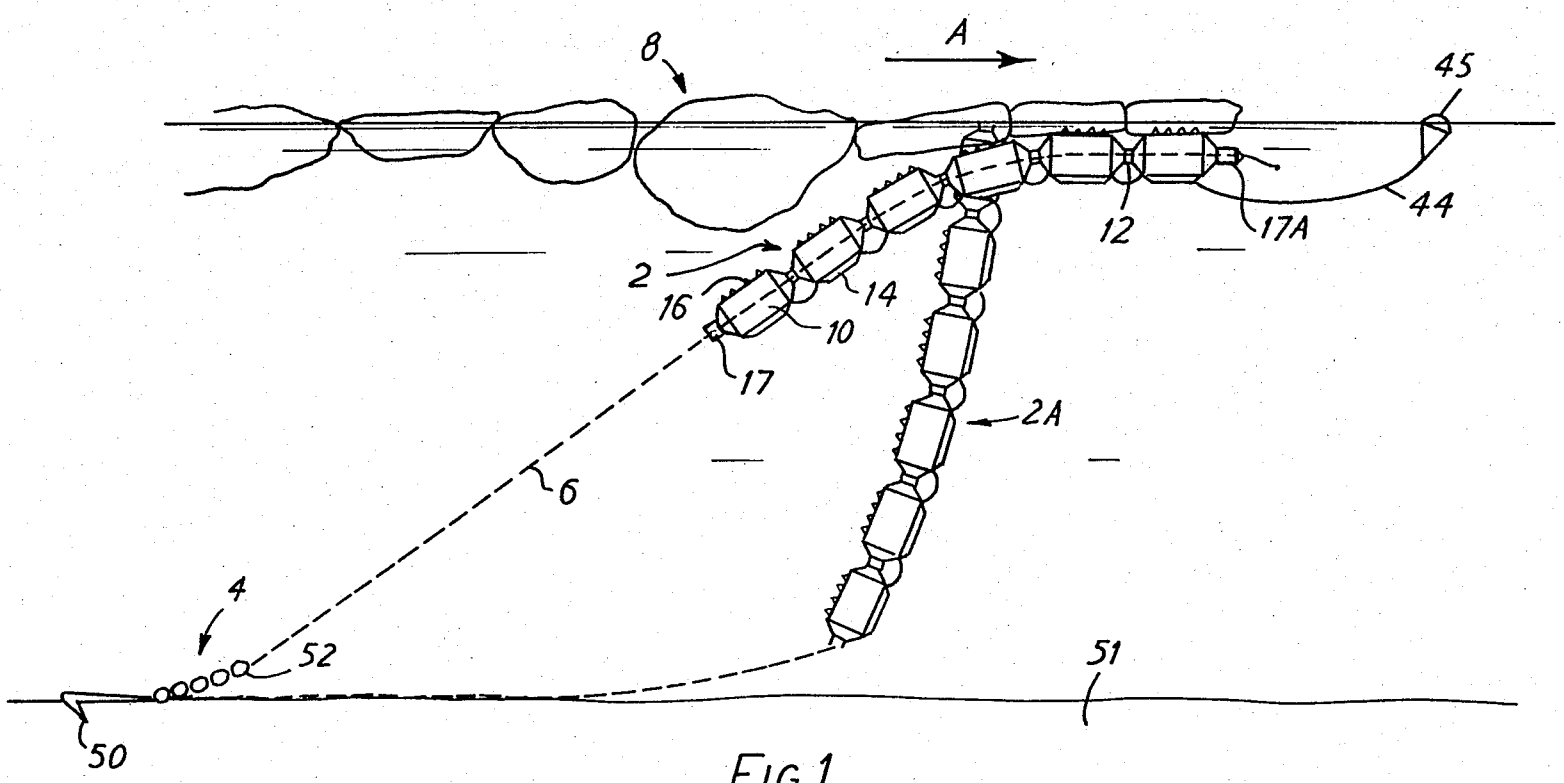
FIG. 1 is a schematic side elevation of drag units anchored to the sea-bed.

Referring firstly to FIG. 1, a drag unit comprises a drag element 2, an anchorage 4 and an anchor line 6 connecting the drag element 2 to the anchorage 4. Pack ice 8 is moving in the direction indicated by the arrow A, over a part of the drag element 2.

The drag element 2 comprises a line of floats 10, threaded onto the anchor line 6, separated by elastic squash blocks 12. The floats 10 are rigid but form a drag element sufficiently flexible to match the under surface of pack ice. The floats are provided on one side with stabilizing weighting, comprising curved concrete blocks 14, and on the opposite side with teeth 16, which, under the influence of the blocks 14, face upwards to engage the under surface of the pack ice 8.

The first and last floats of the drag element 2 are anchored to the anchor line at 17 and 17A respectively.

Figure 2:
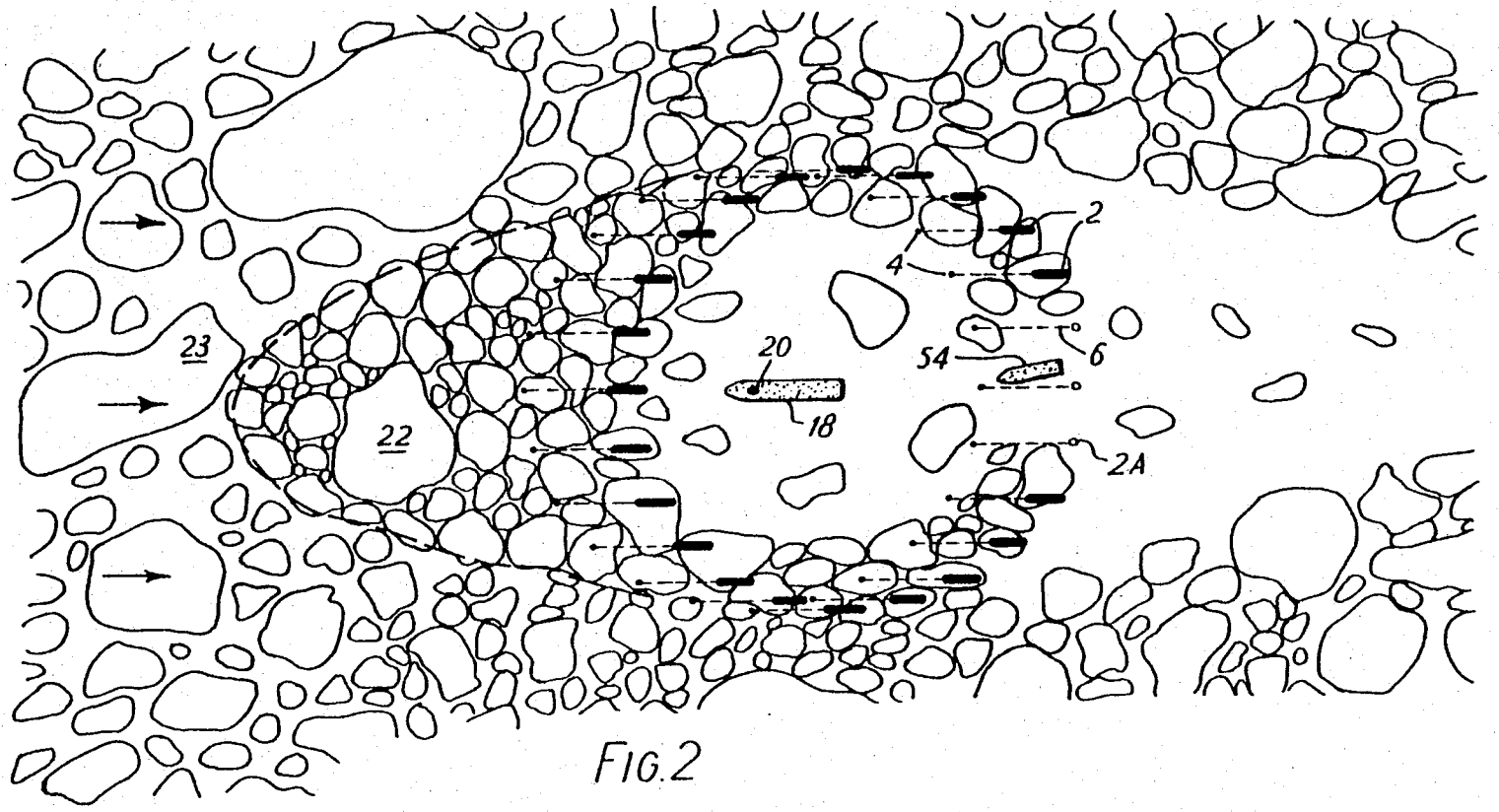
FIG. 2 is a plan view, from above, of a circular array of drag units protecting a drilling installation.

As is shown in FIG. 2, drag elements 2 are arranged as a circle around an installation 18 to be protected. Although FIG. 2 is a view from above and the drag elements are located in the main beneath ice structures, the drag elements are shown in solid black shading, for clarity. The drilling centre 20 of the installation, here shown as a drill-ship which can "weather-vane," that is, turn with the prevailing wind and current, coincides with the centre of the circle defined by the anchorages 4 of the drag elements 2. Naturally the circular protection area defined by the drag elements 2 is always displaced downstream from the circle defined by the anchorages 4, but the circular protection area is large enough for the drill ship to remain in the protection area.

The teeth 16 of the drag elements 2 cut into the underside of the pack ice passing over the elements, creating a drag force and slowing down the ice. When large ice structures have passed over the drag elements and have entered the protection area most of their momentum has been lost and they cannot damage the installation 18. The spacing of the drag elements is such that ice structures too small to damage the installation even at their normal flow speed may pass between the drag elements and into the protection area. Larger ice structures will however be engaged by the drag elements and be decelerated.

Upstream of the protection area a pile-up of slowly moving, densely packed, ice forms a wedge shaped island indicated within a broken line as 22 in FIG. 2. This island acts to deflect ice structures to one side or the other, and hence around the protection area. Still further upstream, the island influences the ice pack flow by a bumping process which urges the ice structures to one side or the other of the island and protection area. The larger ice structures tend to wheel or spin to one side due to their initial collision with the island being to one side of the centre of gravity. For example, the ice structure 23 has collided with the upstream end of the island 22 to the left of the centre of gravity of the structure 23. The structure will wheel anticlockwise and will probably pass to the right of the island 22 and of the protection area. This wheeling, or spinning, tends to cause surrounding relatively thin, plate ice to break or raft, and increases the ease with which ice structures can subsequently be deflected.

A drag element will now be described in greater detail with reference to FIGS. 3 to 9.

As previously mentioned, each float 10 of the drag element has teeth 16 on one side and a concrete stability block 14 on the other. The teeth are arranged in three rows displaced along the length of the float, each row comprising five teeth. The teeth of the rows are transversely staggered from one another so that no tooth follows the line of a preceding tooth. It will be appreciated that only one row has been shown in FIG. 4, for clarity. The forward edge of each tooth, on that side which first engages moving ice, runs to a sharp leading point 24 which can penetrate ice and cause ice shear. Each tooth is generally triangular in transverse cross-section, and has a sharp upper edge 26 and a broad base 28. This shape controls the degree of penetration of the tooth into ice, being greater in soft ice than in hard, so that an approximately constant drag force is exerted on pack ice, regardless of the condition of the ice.

Teeth of the design described satisfy the important requirement that they should penetrate ice without becoming clogged by it. It will be apparent that other designs of teeth, or other types of abrasive surface, could be used to the same effect.

The teeth may readily be fitted onto and removed from the float. Each tooth has at its base a T-section groove 30 (see FIGS. 7 and 8) which tapers towards the point 24 of the tooth. Each tooth is fitted onto a correspondingly tapering rail 32 provided at the surface of the float 10. It will be apparent that the ice moving over the teeth helps to maintaining the teeth securely on their mountings, but that teeth may readily be replaced, for example by divers.

Each tooth is associated with a flap 36, (not shown in FIGS. 6 to 9), hinged at one end 38 and apertured to fit over the tooth at the other. Each flap is movable by a hydraulic piston and cylinder arrangement 39, shown in FIG. 5, between a retracted position, x, in which the flap lies flat against the surface of the float 10 adjacent the base of the tooth, and an extended position z in which the flap is adjacent the upper edge 26 of the tooth, the tooth no longer projecting above the flap. The flap may be fixed at the extreme positions x and z or at intermediate positions such as y. The flaps can be used to de-ice and clear the teeth and also to control the effectiveness of the teeth by determining the depth to which they can penetrate ice. In an alternative embodiment these functions can be performed by retractable teeth.

Inside each float are two flotation tanks 40, permanently full of air, positioned in the upper, toothed, region of the float; two fuel storage cannisters 41 in the lower region; and a central tube 42 through which the anchor line 6 passes. The remainder 43 of the inside of the float is space which may be filled with water or air, as required, by standard means not shown in the drawings, in order to vary the buoyancy of the float. The respective regions 43 of the floats 10 of each drag element communicate with each other by means of tubing contained in an umbilical 44 which links the floats to each other and to a trailing control float 45. The umbilical 44 houses the various control lines needed to control the equipment of the drag unit.

The fuel cannisters 41, containing, for example, oxygen and propane fuel, are required in order to heat the teeth, and thus to help prevent ice build-up. In an alternative embodiment the teeth can be electrically heated. In a further embodiment the teeth can be warmed to the necessary extent by using heat collected from surrounding water moving under convection. The bulk of the heat can be collected by the surface of the floats 10, on which the teeth are mounted, and transferred to the teeth by conduction, through the closely fitting rail and groove mountings 30/32.

Between each pair of adjacent floats is an elastic squash block 12, and torque chains 46 which limit the extent to which floats can turn with respect to each other.

Figure 10:
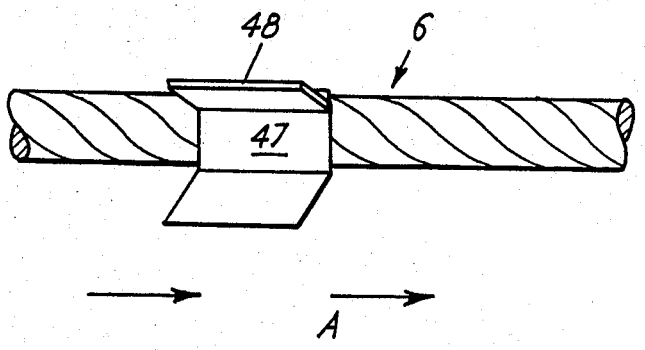
FIG. 10 shows a detail of an anchor line.

The anchor line 6, as is shown in FIG. 10, is fitted at intervals along its length, between the drag element 2 and the anchor 4, with collars 47 from which project radial fins 48. If, as a deep ice structure approaches a drag element, the ice structure comes into contact with the anchor line 6, the fins will cut a groove in the surface of the ice and thus eliminate any tendancy for the anchor line to slip over the surface of the ice structure and carry the drag element to one side.

The anchorage 4, as shown in FIG. 1, consists of an anchor 50 embedded in the sea-bed 51, and clump weights 52 threaded onto the anchorline, adjacent the anchor.

The buoyancy of the floats may be altered by pumping air or water into the regions 43 of the floats, to alter the drag force applied to ice or to take drag elements out of use altogether. For example, it may be desired to sink, or 'park', drag elements on the downstream side of the protection circle, in order to allow perfectly free passage to ice structures leaving the protection area, so keeping the protection area relatively free of ice structures. A 'parked' drag unit is shown as 2A in FIG. 1. It will be noted that the parked drag element trails down from the surface of the water, the floats being non-buoyant at one end and slightly buoyant at the other, due to the use of flotation tanks of different size in different floats of the drag element.

Each drag element may be parked when the drag element is within a predetermined arc, measured from the installation, on the downstream side of the protection area, i.e. when the bearing on which the ice is moving is within a pre-determined angle to the bearing of the anchorage of the drag unit from the installation. The pre-determined arc, providing an exit from the protection area for ice structures which have entered it, might, for example, be 50°, as shown in FIG. 2.

Drag elements may be parked manually under the control, for example, of a supply boat 54. Alternatively, elements may be parked under automatic control. Various methods may be used; one will be described with reference to FIG. 11 of the accompanying drawings.

Figure 11:
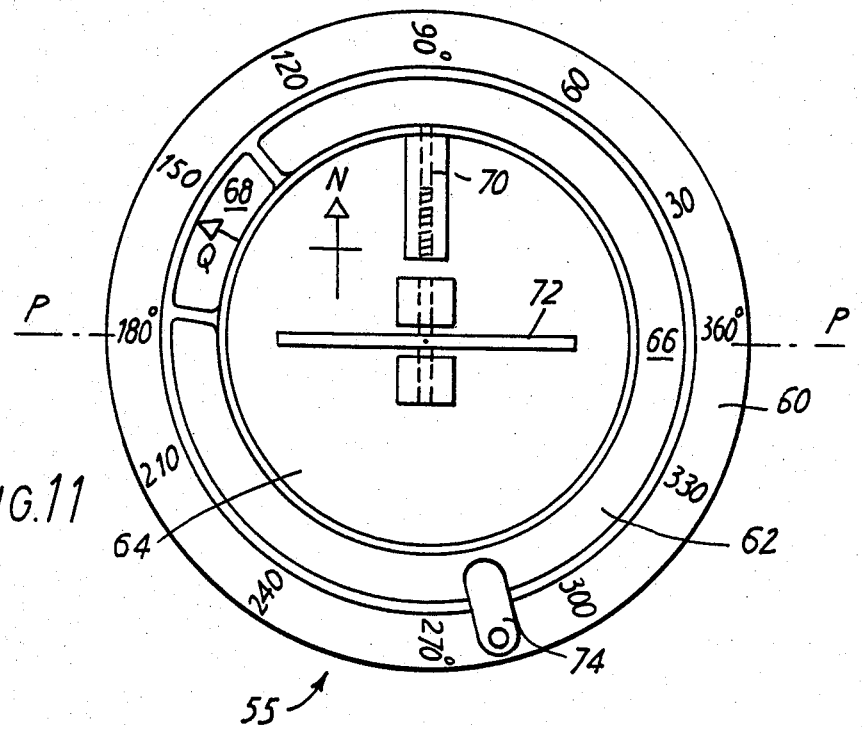
FIG. 11 is a plan view of gyroscopic control apparatus for use with a drag unit.

FIG. 11 depicts a gyroscopic control device 55. Each drag unit incorporates such a device, which may for example, be mounted on the drag element 2 or the control float 45 trailing the drag element 2, connected to the drag element by the umbilical 44.

The control device 55 comprises a lower, circular plate 60, which is gimbal mounted so that it lies permanently in a horizontal plane. It is marked anti-clockwise in degrees and is mounted such that the 180° and 360° markings are aligned with the longitudinal axis P—P of the drag unit.

The plate 60 has a vertical spindle on which are mounted middle and upper plates 62 and 64 of successively smaller diameter. The plates 62 and 64 are independently rotatable on the spindle and therefore on the lower plate 60.

The middle plate 62 is provided with two electrically conductive sectors 66 and 68, electrically insulated from one another. The sector 68 is of 50° arc and is used to provide the control signal to park the drag element, as will be described.

The upper plate 64 is provided with a spring loaded contact brush 70 which makes contact with the conductive sectors of the middle plate 62. A magnet or gyroscope 72, is set so that the contact brush is always at the north most part of the plate 64.

A clamp 74 is provided so that the lower and middle plate can be clamped together.

A device is used as follows: the horizontal bearing of the anchorage 4 from the centre of the protection area is calculated for the drag unit concerned. The middle plate 62 is then clamped to the lower plate 60, such that the middle of the parking sector 68 of the middle plate 62, indicated by the arrow Q, is aligned with this bearing. The contact brush 70 will then contact the conductive pathway of the parking sector 68 when the drag element is within a 50° arc on the downstream side of the installation. When this happens a circuit is provided to open spring loaded valves at each end of the drag element to enable air to escape from one end and water to enter the other, so that the regions 43 of the floats 10 are filled with water and the drag element is parked. When, subsequently, the brush 70 contacts the working sector 66 of the middle plate 62 it opens valves to allow compressed air to be admitted to the drag element (from a supply, not shown) and water to be expelled therefrom, so that the drag element rises to its working position.

The drag element numbered 2 in FIG. 1 is in a typical working position, with about half its floats engaging the underside of the ice pack. Alternatively the byoyancy may be altered so that more or all of the floats engage the ice.

Figure 3:
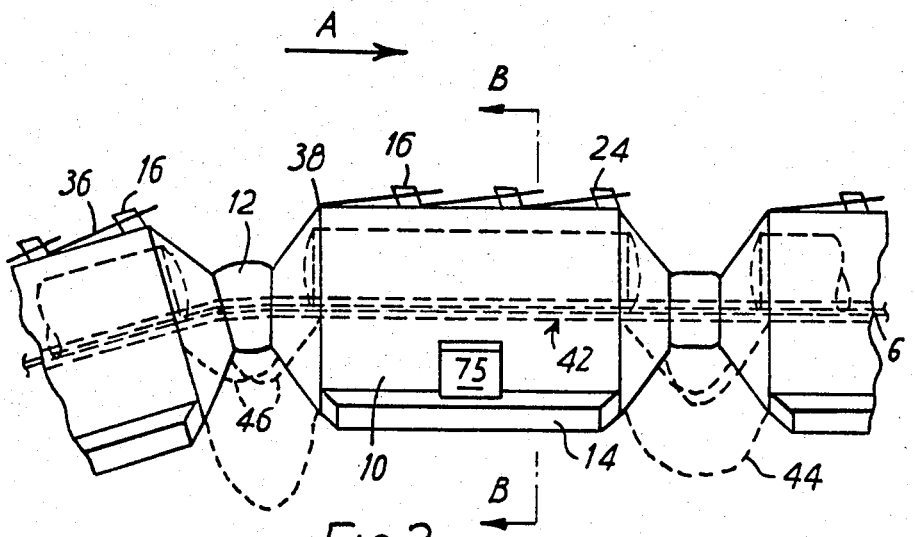
FIG. 3 is a side elevation of a portion of a drag element.
Figure 4:
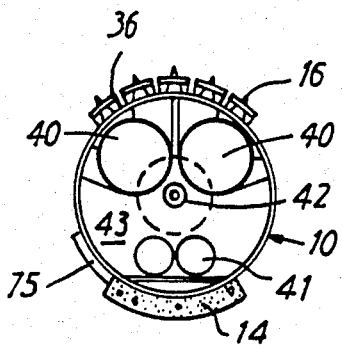
FIG. 4 is a section along the line B—B of FIG. 3.
Figure 5:
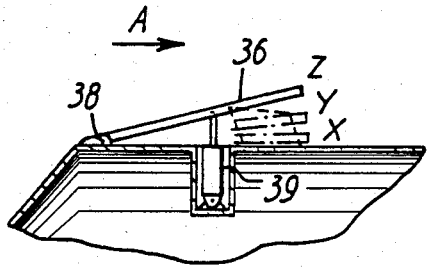
FIG. 5 is a side view of tooth and ice-clearing flap of the drag element.
Figure 9:
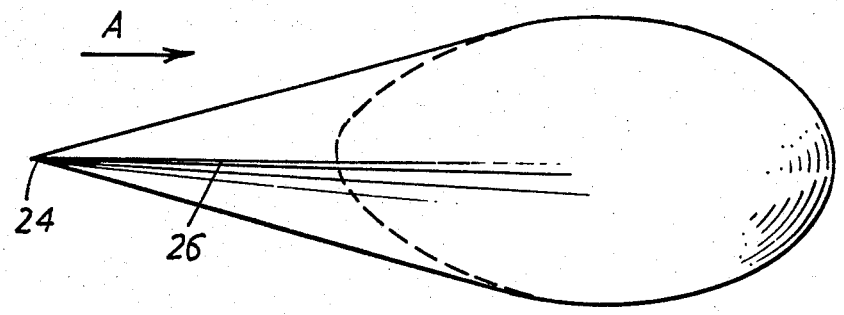
FIG. 9 is a plan view of the tooth of FIG. 6.

Each drag element may be controlled—with respect to its buoyancy, tooth heating, position of the flaps over the teeth etc.—by controls accessible at the control float 45, or else to a diver, at a control panel 75 disposed on one or more of the floats 10 (see FIG. 3).

Figure 12:
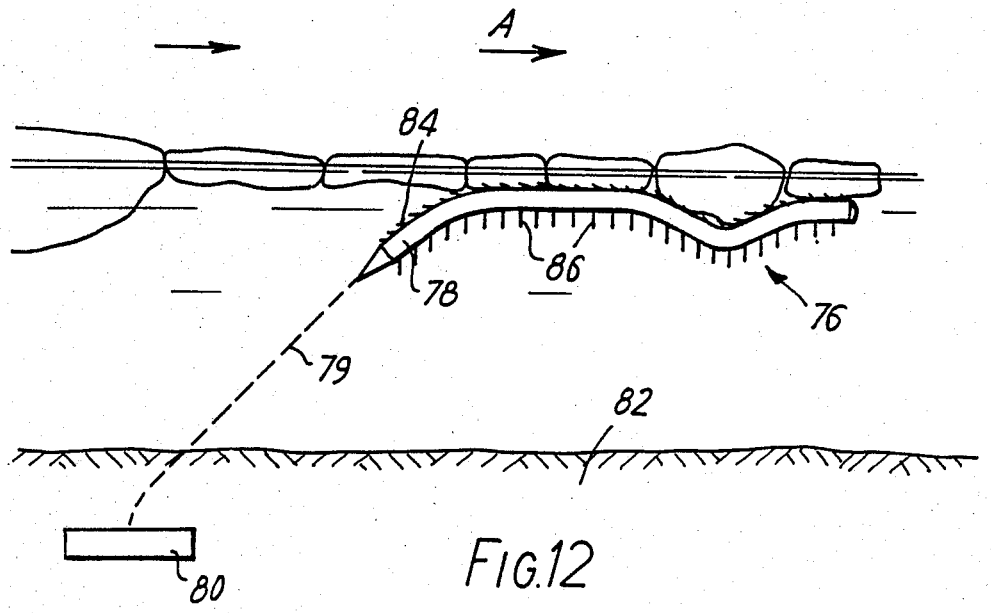
FIG. 12 is a schematic view of an alternative embodiment of protection apparatus.

A second embodiment of the drag element 76 is shown schematically in FIG. 12. The drag element comprises a pair of flexible inflated tubes 78 arranged side-by-side and enclosed within a net. The net is attached to the anchor line 79 and thence to an anchorage 80, consisting of an concrete block embedded in the seabed 82.

The drag element carries teeth 84 on its upper surface, fixed onto numerous top plates (not shown) and, suspended from its lower surface, stabilizing plates 86.

As is shown in FIG. 12, the drag element is sufficiently flexible to match the contours of the underside of the ice to be decelerated.

One embodiment of the invention envisages a protection area of about 150 meters in diameter, surrounded by a drag area of about 500 meters in diameter, using a total of eighty 100 tonne drag elements, and providing a total drag force of 8,000 tonnes. If a twenty million tonne ice island approaches the protection system at a speed of 50 cm. per second, then assuming that half the drag elements act upon the island and ignoring the effect of the surrounding sea water, the ice island would be stopped in approximately 125 meters.

It will be appreciated that there are very many embodiments of apparatus which could protect an installation in the manner described. Various floatable drag elements could be used as well as various anchorages and arrangements for connecting drag elements to anchorages, other than the arrangement disclosed in the examples, in which the single drag element is connected to a single anchorage by means of a single anchor line.

Whilst in the examples the drag elements have been described as being connected to a seabed anchorage, elsewhere in the specification the term 'underwater anchorage' has been used, since the apparatus described could be used in rivers and lakes.

In the examples the drag elements define a circular protection area, and so protect the installation from ice travelling in any direction. However, other arrays of drag elements may be used. For example, when an installation requires protection from ice moving in one direction only, e.g. when an installation is sited in a river or in a maritime region where the direction of the ice flow does not vary, a straight line of drag elements upstream of the installation could provide adequate protection.

I claim:

1. Apparatus for protecting an installation from floating ice moving towards the installation, comprising:

an array of buoyant drag elements upstream of the installation;

a number of underwater anchorages upstream of the installation;

anchor lines connecting the drag elements to the anchorages; and ice penetration means projecting upwards from the surface of the drag elements for penetrating the underside of ice moving over the drag elements, whereby the ice is decelerated.

2. Apparatus according to claim 1, wherein said ice penetration means are teeth, each tooth tapering from a broad base to a narrow upper edge which terminates at the forward end of the tooth in an ice-penetrating point.

3. Apparatus according to claim 2, wherein the teeth of each drag element are arranged in longitudinally spaced rows, the teeth of adjacent rows being transversely staggered from one another.

4. Apparatus according to claim 2, including means for altering the depth to which the teeth may penetrate the ice.

5. Apparatus according to claim 4, including means for retracting the teeth so that they project a shorter distance beyond the surface of the drag elements.

6. Apparatus according to claim 4, wherein each tooth is associated with a flap, each flap being apertured at one end to fit over the tooth and hinged at the other, and being movable between a retracted position in which it is positioned adjacent the base of the tooth and an outward position in which the apertured end is adjacent the point of the tooth, the flap being fixable at said retracted and extended positions and at at least one position therebetween.

7. Apparatus according to claim 2, including heater means for raising the temperature of the teeth above the temperature on the medium which surrounds them.

8. Apparatus according to claim 1, wherein each drag element comprises a plurality of floats, and elastic squash blocks separating said floats from one another, said floats and squash blocks being threaded onto an anchor line, whereby each drag element is generally flexible and can follow the profile of the underside of an ice structure.

9. Apparatus according to claim 8, wherein each float contains a flotation tank which permanently displaces water and a region into which water may be admitted or from which it may be expelled, wherein the flotation tanks at the first end of each drag element are larger than those at the second end so that when the said regions are filled with water said first end remains buoyant while said second end does not, whereby the drag element adopts a parked position in which it trails down from said first end.

10. Apparatus according to claim 9, further including actuating means to cause water to enter said regions of the floats of each drag element which is within a predetermined arc, to park each said drag element, said arc being downstream of the installation and providing an exit for ice which has entered the protection area.

11. Apparatus according to claim 10, wherein the actuating means includes a sensor associated with each drag element for sensing the direction in which the drag element is aligned, each drag element being parked when the bearing on which the ice is moving is within a predetermined angle to the bearing of the anchorage of the drag element from the installation.

12. A structure for protecting an installation from moving ice, comprising a plurality of flotation chambers connectible to an anchorage, elastic squash blocks between said flotation chambers, said flotation chambers and squash blocks being threaded onto an anchor line to form a drag element, whereby each drag element is generally flexible and can follow the profile of the underside of an ice structure, and sharp teeth projecting outwardly from the surface of said flotation chambers to penetrate ice and decelerate it.

13. Apparatus for protecting an installation from ice structures moving towards the installation, comprising:

an array of buoyant drag elements upstream of the installation;

a number of underwater anchorages upstream of the installation;

anchor lines connecting the drag elements to the anchorages, the anchor lines being of sufficient length to allow the drag elements to float; and means at the surface of the drag elements for engaging the undersurface of ice moving over the drag elements to decelerate the ice.

14. Apparatus according to claim 13, wherein the means at the surface of the drag elements are teeth, each tooth tapering from a broad base to a narrow upper edge which terminates at the forward end of the tooth in an ice-penetrating point.

15. Apparatus according to claim 13, wherein the teeth of each drag element are arranged in longitudinally spaced rows, the teeth of adjacent rows being transversely staggered from one another.

* * * * *